US010900172B1

(12) United States Patent
Ivarsson et al.

(10) Patent No.: US 10,900,172 B1
(45) Date of Patent: Jan. 26, 2021

(54) METHOD AND A MACHINE FOR PRODUCING A TISSUE WEB

(71) Applicant: VALMET AKTIEBOLAG, Sundsvall (SE)

(72) Inventors: Hans Ivarsson, Karlstad (SE); Anders Ottosson, Karlstad (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 17/041,143

(22) PCT Filed: Apr. 15, 2019

(86) PCT No.: PCT/EP2019/059681
§ 371 (c)(1),
(2) Date: Sep. 24, 2020

(87) PCT Pub. No.: WO2019/201861
PCT Pub. Date: Oct. 24, 2019

(30) Foreign Application Priority Data

Apr. 19, 2018 (SE) ..... 1850458

(51) Int. Cl.
*D21F 7/12* (2006.01)
*D21F 3/04* (2006.01)
(Continued)

(52) U.S. Cl.
CPC ..... *D21F 3/045* (2013.01); *D21F 5/028* (2013.01); *D21F 7/12* (2013.01); *D21F 11/145* (2013.01); *D21H 27/002* (2013.01)

(58) Field of Classification Search
USPC ..... 162/203, 210, 232
See application file for complete search history.

(56) References Cited

U.S. PATENT DOCUMENTS 5,830,321 A 11/1998 Lindsay et al.
6,187,137 B1 2/2001 Druecke et al.
(Continued)

OTHER PUBLICATIONS

International Searching Authority, International Search Report and Written Opinion for International Application No. PCT/EP2019/059681, dated May 28, 2019, (11 pages), European Patent Office, Rijswijk, Netherlands.

*Primary Examiner* — Mark Halpern
(74) *Attorney, Agent, or Firm* — Alston & Bird LLP

(57) ABSTRACT

The invention relates to a method of producing a structured fibrous web of paper suitable for tissue products. The method comprises forming a fibrous web and conveying the formed fibrous web on a water receiving felt (5) to a dewatering nip. An endless steel belt (11) with a smooth steel surface is passed through the nip together with the fibrous web and the water receiving felt (5) wherein the endless steel belt is heated by heaters ($HE_U$, $HE_L$). After the dewatering nip, the fibrous web is conveyed by the endless steel belt (11) to an endless textured fabric (12) which is permeable to air and to which the web is transferred from the endless steel belt (11) in a transfer nip. The textured fabric (12) runs at a lower speed than the endless belt (11). After the transfer to the textured fabric (12), the fibrous web is carried by the textured fabric (12) to a drying cylinder (17). The transfer nip is formed by two rolls of which one is a suction roll within the loop of the textured fabric. The transfer nip has a length which is 5 mm-40 mm. The endless steel belt (11) has a width that exceeds the width of the textured fabric (12). The invention also relates to a corresponding machine.

14 Claims, 6 Drawing Sheets

(51) Int. Cl.

| | |
|---|---|
| ***D21H 27/00*** | (2006.01) |
| ***D21F 11/14*** | (2006.01) |
| ***D21F 5/02*** | (2006.01) |

(56) References Cited

U.S. PATENT DOCUMENTS

| | | | | |
|---|---|---|---|---|
| 6,287,426 | B1 | 9/2001 | Edwards et al. | |
| 7,588,660 | B2 | 9/2009 | Edwards et al. | |
| 7,789,995 | B2 | 9/2010 | Super et al. | |
| 8,871,060 | B2 | 10/2014 | Klerelid | |
| 2006/0243408 | A1 | 11/2006 | Blodgett et al. | |
| 2009/0205797 | A1* | 8/2009 | Fernandes | D21F 1/0027 162/203 |
| 2010/0065234 | A1* | 3/2010 | Klerelid | D21F 11/006 162/111 |
| 2010/0326616 | A1* | 12/2010 | Klerelid | D21F 11/006 162/205 |
| 2012/0267063 | A1* | 10/2012 | Klerelid | D21F 11/006 162/130 |
| 2014/0130997 | A1* | 5/2014 | Klerelid | D21F 3/10 162/217 |

* cited by examiner

METHOD AND A MACHINE FOR PRODUCING A TISSUE WEB

CROSS REFERENCE TO RELATED APPLICATIONS

This application is a National Stage Application, filed under 35 U.S.C. § 371, of International Application No. PCT/EP2019/059681, filed Apr. 15, 2019, which claims priority to Sweden Application No. 1850458-9, filed Apr. 19, 2018; the contents of both of which are hereby incorporated by reference in their entirety.

BACKGROUND

Related Field

The invention relates to a method and a machine for producing a structured fibrous web, in particular a tissue web. The fibrous web produced may be used as, for example, kitchen towel, toilet paper or facial tissue. In sharp contrast to production of paper where the paper should have high density and printable surface, the tissue paper should have high bulk and optimal absorption using creping technique of the web during production of the web.

Description of Related Art

A machine for manufacturing structured soft paper is disclosed in U.S. Pat. No. 6,287,426. The machine disclosed in that patent has a forming section with a head box and two forming fabrics. The formed web is passed on a water receiving felt through a dewatering nip. An impermeable belt is also passed through the dewatering nip and the web is transferred to the impermeable belt. The impermeable belt then conveys the fibrous web to a wire 22 which has a web-contacting side with a structure. A suction device placed within the loop of the wire is used to pick up the web from the impermeable belt and transfer it to the structured wire. The web is then passed to a drying cylinder which may be a Yankee dryer. When the web is passed from the impermeable belt to the structured wire, a speed difference is used in order to achieve structuring. This structuring is also called a wet creping effect that increase bulk of the tissue web and is typical for tissue paper machines. This wet creping in this position, made when the web is not finally dried, cause a more permanent structuring of the web than the final dry creping made on the web when the doctor blade lift the web from the Yankee. This means that the wire moves at a speed that is less than the speed of the impermeable belt. Such a speed difference is sometimes referred to as "rush transfer". It is stated in that document that the speed difference can be 10-25%. While this machine may give a good result in terms of bulk, the inventor of the present invention has discovered that the paper web may sometimes be damaged. The inventor of the present invention has found that it is difficult to operate such an arrangement at speed differences larger than about 8%. When the speed difference is larger than about 8%, sheet transfer is often lost and the web is damaged. It is therefore an object of the present invention to reduce the risk that the paper web is damaged, even when the speed difference is larger than 8%.

U.S. Pat. No. 7,588,660, or U.S. Pat. No. 7,789,995 discloses another machine for manufacturing structured soft paper. This technology was developed by Georgia-Pacific Consumer products and is sold under the name eTAD or TAD™. In that patent, the formed web is transferred to a felt and passed through a single-felted dewatering nip in which the fibrous web is passed to a solid transfer roll with a smooth surface that may be heated. From the transfer roll, the web is passed through a nip to a creping fabric. Such an arrangement requires that three rolls cooperate which is difficult due to deflection of the rolls in the nips as well as possibilities of controlling each individual nip individually. Moreover, the creping wire may be subjected to wear as it contacts the transfer roll.

Another machine for producing paper webs is disclosed in U.S. Pat. No. 6,187,137, That document discloses how a wet web may be transferred first from the forming section to a first transfer fabric and from the first transfer fabric to a second transfer fabric which may be adapted to impart texture and bulk to the web, Transfer to the second transfer web may be done by means of rush transfer whereafter the web may be transferred to a cylindrical dryer.

Yet another machine is discussed in U.S. Pat. No. 5,830,321, In that patent, rush transfer is discussed and the transfer takes place when the fabrics involved pass over a vacuum shoe and a deflection element respectively. Rush transfer is a frequently used technique when producing tissue paper with high bulk as it introduce a creping effect onto the web during transfer.

Finally, in U.S. Pat. No. 8,871,060 is disclosed another improved machine for manufacturing structured soft paper where the transfer between a first dewatering felt and the endless textured fabric, i.e. creping fabric, takes place on an endless smooth belt with a surface coating of polyurethane. This technology was developed by Valmet AB and is sold under the name QRT™. This design avoid usage of three cooperating rolls as needed in the machine as disclosed in U.S. Pat. No. 7,588,660.

In summary, above transfer systems in tissue machines disclose the difficulties finding a system and design of the transfer system between the dewatering felt and the subsequent textured fabric, where the system must have a transfer surface with a surface that both provide for proper adherence of the web after the felt, and proper release of the web onto the subsequent textured fabric. The operating window for such transfer system and selection of surface material that both adhere and release the web in opposite ends is very narrow, and must enable a proper rush transfer to be established.

In paper production, where rush transfer is not sought for, Valmet has developed the OptiPress™ Metal Belt, using a heated metal belt for pre-calendering, obtaining excellent macro scale smoothness, even topography after coating, better optical properties and excellent macroscale topography with same or better stiffness. The paper grades produced has some 60 to 70 g/m$^2$ base paper. However, these product properties are not sought for when producing tissue paper.

BRIEF SUMMARY

The invention relates to a method of producing a structured fibrous web of paper suitable for tissue products. The method comprising the steps of:

- forming a fibrous web and conveying the formed fibrous web on a water receiving felt to a dewatering nip formed by a first press unit and a second press unit and where an endless steel belt is passed through the nip together with the fibrous web and the water receiving felt,
- the endless steel belt having at least a steel surface which contacts the fibrous web in the dewatering nip wherein the endless steel belt is heated by heating medium in a position at least partly before the fibrous web is applied onto the endless steel belt;

after the dewatering nip, conveying the fibrous web by the endless steel belt to an endless textured fabric which is permeable to air and to which the web is transferred from the endless belt. The textured fabric running at a lower speed than the endless steel belt and a speed difference in the range 2-25% (RT %). After the transfer to the textured fabric, conveying the fibrous web by the textured fabric to a drying cylinder, wherein the web is transferred from the endless steel belt to the textured fabric in a transfer nip, the transfer nip being formed between a first transfer nip roll that lies within the loop of the endless steel belt and a second transfer nip roll which is a suction roll located within the loop of the textured fabric, the transfer nip having a length in the machine direction which is in the range of 5 mm-40 mm.

These method steps enable an increase in speed difference between the endless steel belt and the textured fabric as the fibrous web may be subjected to improved web transfer while being transported on the endless steel belt compared to using an endless polyurethane belt. This improvement in web transfer may be used to increase production capacity or increasing the bulk in the produced tissue product. The risk of web breakage when transferring the fibrous web from the endless steel belt onto the textured fabric may alternatively be reduced if all other production factors are equal, as the increased dewatering during transport on the endless steel belt reduce the initial adhesive attraction between the initially moisty fibrous web and the endless steel belt.

In a preferred method of operation could the endless steel belt have a speed that is above 15%, i.e. in the range 15%-25%, higher than the speed of the textured fabric, i.e. almost double speed difference compared to using PUR-belts.

Heating the steel belt may increase the temperature of the fibrous web by as much as 20° C., reaching 4-6%-units higher dryness already during transfer of the formed fibrous web from the forming section to the texturing section, thus decreasing the necessary effect in subsequent drying section after the texturing section.

In a recommended way of operation is the endless steel belt heated on both sides of the belt. This may reach higher temperature in the steel belt and require less bulky heaters.

Further, in yet a preferred way of operation may the endless steel belt be heated in a heating zone extending at least 50-70% of a distance ranging from 1 to 7 meters. A heating effect distributed over a longer stretch is needed in order to be able to heat the endless steel belt that may travel at very high speed and therefore has less retention time in the heating zone.

Finally, in a preferred way of operation is the endless steel belt running in a loop over at least two rolls that deflects the endless steel belt over at least 90 degrees of the circumference of the rolls and that the rolls may have a function as a guide roll, a press roll or a transfer nip roll and the total length of the endless steel belt exceeding the total circumference of the rolls by a factor above 2. This design will enable location of above heaters in the loop of the endless steel belt and between 2 neighboring rolls supporting the loop.

The invention also relates to a machine for producing a structured fibrous web of paper suitable for tissue products. The machine comprising;

a forming section that includes a first (3) and a second (5) forming fabric;

a dewatering nip (PN) defined by a first (8) and a second (9) press unit, through which dewatering nip a water receiving felt (5) is arranged to carry a fibrous web (W) formed in the forming section;

an endless steel belt (11) arranged to run in a loop over at least two rolls (9,14) through the dewatering nip and arranged to pick up the paper web and having at least one steel surface facing the paper web that passes through the dewatering nip;

at least one heater ($HE_L$ $HE_U$) arranged close to the endless steel belt and heating the steel belt in a position at least partly before the fibrous web is applied onto the endless steel belt a textured fabric (12) arranged to pick up the paper web from the endless steel belt (11) at a point downstream of the dewatering nip; and a drying cylinder (17) to which the textured fabric is arranged to carry the paper web; and a transfer nip (TN) in which the paper web is transferred from the endless steel belt to the textured fabric, the transfer nip being formed between and by a first transfer nip roll (14) located within the loop of the endless steel belt and a second transfer nip roll (15) which is a suction roll that is located within the loop of the textured fabric, the textured fabric (12) driven by rolls (15,20) in the loop of the textured fabric loop at a lower speed than the endless steel belt (11) driven by rolls (9,14) in the loop of the endless steel belt (11) at a speed difference in the range 2-25% (RT %); the transfer nip having a nip length in the machine direction that is in the range of 5 mm-40 mm.

The heater is preferably located close to the position before the fibrous web is applied onto the endless steel belt reducing heat from dissipating from the endless steel belt, making most effect of the heating. The heater may thus be a roll that has a surface exposed by the heater and located on the roll close to the position before the fibrous web is applied onto the endless steel belt running over the heated roll In a further preferred embodiment of the inventive machine is at least one heater a heating box ($HE_U$ or $HE_L$) arranged immediately close to a surface of the endless steel belt and heated by steam. The box may have a heating surface exposed to a part of the endless steel belt located at a short distance, i.e. 0.1-5 mm from said endless steel belt, or alternatively using low friction guides on the edges of the box with no gap between the box and the endless steel belt.

In a further preferred embodiment of the inventive machine is the endless steel belt heated on both sides of the endless steel belt by an upper heater ($HE_U$) and a lower heater ($HE_L$). Heating from both sides enable a higher obtainable temperature throughout the thickness of the steel belt.

In another embodiment is the endless steel belt heated by at least one steam heated roll supporting the loop of the endless steel belt. This could be done in addition to heating boxes.

In a further preferred embodiment of the inventive machine is the endless steel belt heated in a heating zone with heaters extending at least 50-70% of a distance ranging from 1 to 7 meters between two rolls supporting the loop of the endless steel belt. Arranging the heaters between two rolls enable an extended box design of the heaters, preferably running in parallel with the endless steel belt.

In still a further preferred embodiment of the inventive machine the endless steel belt (11) runs in a loop over at least two rolls (9,14) that deflects the endless steel belt over at least 90 degrees of the circumference of the rolls and that the rolls may have a function as a guide roll, a press roll or a transfer nip roll and the total length of the endless steel belt exceeding the total circumference of the rolls by a factor above 2.

In another preferred embodiment of the inventive machine is the drying cylinder a Yankee drying cylinder to which the paper web is transferred from the textured fabric in a second transfer nip formed between a nip roll and the Yankee cylinder; and in which a doctor blade is arranged to act on the Yankee cylinder. This set up enable a very compact Tissue machine where the forming section is followed by the transfer by the endless steel belt to the textured fabric, and with a Yankee cylinder immediately after the textured fabric.

In an alternative preferred embodiment of the inventive machine is the drying cylinder a through air drying cylinder which is wrapped by the textured fabric over a part of its circumference. Hence, the drying roll after the textured fabric may be any kind of drying roll, either a single Yankee cylinder or alternatively a through air drying cylinder.

In final alternative preferred embodiment of the inventive machine may the subsequent drying of the fibrous web after transfer from the textured web takes place on a sequence with at least one through air drying cylinder and a final Yankee cylinder. Thus, final drying may take place in a single step or in multiple steps in 2.3 or more drying rolls of different design.

BRIEF DESCRIPTION OF THE FIGURES

In the following schematic drawings are details numbered alike in figures, and details identified and numbered in one figure may not be numbered in other figures in order to simplify figures.

DETAILED DESCRIPTION OF VARIOUS EMBODIMENTS

Figure 1:
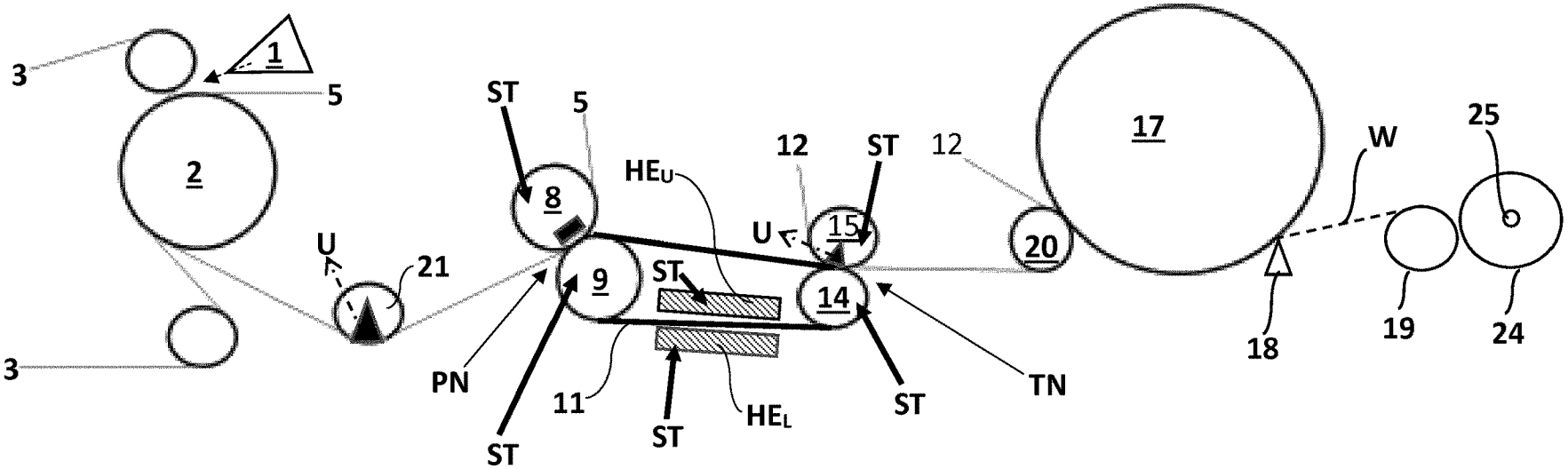
FIG. 1; shows a schematic side view of a first embodiment of the invention with the inventive steel belt running over only 2 rolls, in which a Yankee drying cylinder is used for the structured fabric web.

With reference to FIG. 1, a machine for producing a structured fibrous web of paper is shown. The machine comprises a forming section. The forming section has a head box 1 that is arranged to inject stock into a gap between a first forming fabric 3 and a second forming fabric 5. Both forming fabrics 3, 5 may be foraminous wires (i.e. wires that are permeable to water). However, in advantageous embodiments, the first forming fabric 3 is a foraminous wire while the second forming fabric 5 may be a water receiving felt. It should be understood that in the context of this patent application and any patent issuing therefrom, the term "forming fabric" is used for any fabric used during forming of the fibrous web. This could include both foraminous wires and felts.

The reference numeral 2 designates a forming roll. In FIG. 1, it is shown how the first forming fabric 3 is arranged to run in a loop guided by guide rolls 4, seen in FIG. 2. The second forming fabric 5 is guided by guide rolls 6, seen in FIG. 2. The newly formed fibrous web is carried on the outer surface of the felt 5 to a dewatering nip PN (i.e. a press nip PN) formed between a first press unit 8 and a second press unit 9. In the embodiment of FIG. 1, the felt that passes through the dewatering nip is identical to one of the forming fabrics. It should be understood that embodiments are conceivable in which the fibrous web is first formed between two forming fabrics and then transferred to a felt which is not used as a forming fabric. However, the overall design of the machine becomes more compact when one of the forming fabrics is the same felt that carries the web to the dewatering nip PN. The press units 8, 9 will normally be formed by rolls such as for example deflection controlled rolls. In the dewatering nip PN, water is pressed out of the fibrous web such that the dry solids content of the web increases. Dry solids content after the dewatering nip PN may be in the range of 40%-50%. Optionally, a suction roll 21, with a sector in the nip area connected to suction/underpressure U, may also be arranged within the loop of the second forming fabric 5 to dewater the felt and the newly formed fibrous web by vacuum dewatering. An endless steel belt 11 is also arranged to pass through the dewatering nip PN together with the felt 5 and the web W. The endless belt 11 forms a loop running over two rolls 9 and 14. In all figures is the endless belt slightly thicker than preceding forming felt and subsequent textured fabric According to the invention is at least the side of the endless belt 11 that faces the paper web covered by a smooth steel surface facing the fibrous web when the fibrous web and the endless steel belt 11 pass through the dewatering nip. Hence, the steel belt may be a homogenous steel belt but may also be a belt with a base material covered by a thin steel sheet layer. As will be described later the steel belt may be heated and increased weight of the steel belt may retain the temperature better. In the prior art design, such as that shown in U.S. Pat. No. 8,871,060, is a polyurethane (PUR)-covered endless belt 11 used, but this design does not enable heating and drying of the fibrous web, and the PUR-covered endless belt increases the risk for the web break as the fibrous web may stick to the PUR-covered endless belt 11. Further, the PUR-covered endless belt may reduce the acceptable speed difference (RT %) between the following structured fabric and the PUR covered endless belt. The speed difference allowable typically has been found at some 8-15 RT % when using PUR covered endless belts.

The endless steel belt 11 is smoother than the felt 5. Therefore, the fibrous web will adhere to the endless steel belt 11 after passage of the dewatering nip PN. After the dewatering nip PN, the fibrous web is carried by the endless steel belt 11 to a transfer nip TN downstream of the dewatering nip PN which transfer nip TN is formed by a first transfer nip roll 14 located within the loop of the endless steel belt 11 and a second transfer nip roll 15 which is a suction roll. A textured fabric 12 runs in a loop through the transfer nip TN and the textured fabric 12 may be guided by one or several guide rolls 23 (not shown in FIG. 1 but seen in FIG. 2). The second transfer nip roll 15 is located within the loop of the textured fabric 12. The textured fabric 12 is arranged to pick the fibrous web from the endless belt 11 when the fibrous web passes the transfer nip TN such that the fibrous web is transferred to the textured fabric 12. The transfer is secured by means of the second transfer nip roll 15 since this roll preferably is a suction roll. The textured fabric 12 is air permeable such that the second transfer nip roll 15 may draw air through the textured fabric and cause the web to adhere to the textured fabric. The air permeable textured fabric 12 may be a woven fabric such as a forming wire or a through air drying fabric (TAD fabric).

The smooth surface of the endless steel belt 11 makes the web adhere to the endless steel belt but the adhesive force is not very strong, and the web can be picked up from the endless belt 11 without substantial risk of web breaks if the speed difference (RT %) is kept within limits, especially if a suction roll 15 is used in the transfer nip.

The inventors have seen that the adhesive adherence of the moisty fibrous web on the smooth endless belt 11 works in the same way when using a PUR-coated endless belt (like shown in U.S. Pat. No. 8,871,060) as when using a smooth endless steel belt. The moisty fibrous web is more or less sucked onto the surface due to the water content press out on the surface of the fibrous web in the press nip PN. As the fibrous web is carried along on the surface of the PUR-coated endless belt only a minor evaporation of water takes place, but if an endless steel belt is used a better heat conductivity between steel belt and fibrous web may be obtained. The thermal conductivity of stainless steel lies at 12-45 W/m K, while the thermal conductivity of PUR lies at a fraction thereof at 0.20-0.45 W/m K, i.e. only about 1% of that of steel. In fact, PUR is most frequently used as heat insulation material due to the very low thermal conductivity.

It has also been seen that due to the usage of steel in the endless belt 11, the endless steel belt may easily be heated to such extent that the fibrous web may increase the temperature about 20° C. using steam heated heaters on both sides of the steel belt close to the surface of the steel belt. Heating the fibrous web by 20° C. could evaporate 20% more water, obtaining 6% higher dryness units, as seen in heating steel belts in pre-calendaring installations. The increased dewatering effect is to great extent contributed to lowered viscosity of the water content. The above figures on evaporation effect from a dual sided heating arrangement using steam heated boxes has been proven in up to date paper machines in calendaring, but application in a tissue machine with more bulk in the fibrous web should likely result in even better figures.

As to principles of heating the endless steel belt could alternatively electrically heaters be used instead of steam boxes. Complementary to the heating boxes $HE_U$ and $HE_L$ shown in figures may also additional heating of the steel belt be obtained from heated rolls, preferably steam heated rolls well known per se. In FIG. 1 may roll 9 be steam heated but also roll 14. If steam heated rolls could elevate the temperature of the fibrous web by 10-20° C. could even the heaters $HE_U$ and $HE_L$ be omitted.

The heating of the box heaters $HE_L$ and $HE_U$ may be done with steam indicated with ST in FIG. 1, and the heating of the rolls 9 and 14 in the loop of the endless steel belt 11 may also be done by steam as indicated.

The effect of evaporation ahead of transfer to a textured fabric between the press nip PN and the transfer nip TN is of outmost importance when transferring the fibrous web onto the textured fabric, as the adhesive effect onto the stainless steel belt due to water content decreases during the travel between the press nip PN and the transfer nip TN, and the fibrous web may be transferred without breaking and at higher relative speed difference which is of importance for obtaining a high bulk in the web as the web is subjected to a creping effect.

The textured fabric has a texture, i.e. a three-dimensional structure on at least the side facing the fibrous web. The textured fabric 12 imparts a three-dimensional structure on the fibrous web when the second transfer nip roll 15 (the suction roll) draws the web by suction against the textured fabric 12. Thereby, the bulk of the web is increased. To further increase the bulk of the web, the transfer from the endless belt 11 to the textured fabric 12 is made in the form of a rush transfer (RT %), i.e. there is a speed difference between the textured fabric 12 and the endless belt 11. Using a certain degree of speed difference helps sheet transfer if the difference in speed is not too large. However, speed differences above a certain limit can actually make sheet transfer more difficult. The difference in speed may also improve bulk. When the paper web is picked up by a textured fabric, the speed difference may also contribute to improving the molding of the web into the textured fabric, thereby further improving the bulk.

The endless steel belt 11 is preferably a belt with a smooth surface and impermeable to water and air. An endless steel belt 11 with a textured surface (on the side facing the fibrous web W) and which is impermeable to water and air is considered not quite as advantageous but almost as good as a smooth and impermeable belt. However, embodiments are also conceivable in which the endless steel belt 11 has a limited permeability to air. The permeability to air should not exceed 0.15 m/s (corresponding to 35 CFM) at a pressure drop of 125 kPa between opposite sides of the belt. If the endless steel belt 11 is permeable to air, a smooth belt is the most preferred choice but a textured belt with a limited permeability (not more than 0.15 m/s) can be considered.

The use of a smooth endless steel belt 11 is advantageous for sheet transfer. Preferably is the steel belt 11 heated by heaters $HE_U$ and $HE_L$ arranged on both sides of the endless steel belt in a location between two rolls 9,14 where the steel belt pass in a straight line. In FIG. 1 is an upper heater $HE_U$ arranged above the steel belt 11 and a lower heater $HE_L$ arranged below the steel belt. The heaters $HE_U$ and $HE_L$ may be electrical heaters or steam box heaters.

In the dewatering nip PN, the surface of the fibrous web will tend to adhere to the smooth surface and will follow the endless steel belt 11 after the dewatering nip PN instead of following the felt. However, as the web passes through the dewatering nip PN and water is forced out of the web, and the subsequent heating from the heated steel belt, the dry solids content of the web increases. Compared to a web with low dry solids content, a dryer web has less adherence to the surface of a transfer fabric such as the endless steel belt 11. Therefore, when the web W becomes successively dryer, due to continued heating from the heated steel belt 11, it will become easier to transfer the web W to a following fabric. Immediately after the dewatering nip PN, the web tends to adhere relatively well to the endless steel belt 11. The inventor has observed that adherence of the fibrous web W to the endless steel belt 11 decreases with time after passage of the dewatering nip due to water evaporating from the fibrous web, but if a PUR-coated belt is used, heating is not possible, and hence the water content of the fibrous web decreases to a very limited extent. But if a steel belt is heated could the water content of the fibrous web decrease 2- to 3-fold more.

Without wishing to be bound by any particular theory, it is believed by the inventor that a thin water film is present on the endless steel belt 11 immediately after the nip and that this thin water film creates adhesion between the endless steel belt 11 and the fibrous web W. But if the steel belt is heated is the thin water film directly affected and may increase in temperature and as an effect will increase evaporation rate.

Regardless of whether this explanation is correct or not, experience has showed the inventor that adhesion decreases gradually after the dewatering nip PN when using an endless steel belt, and especially if the steel belt is heated. For this reason, the distance from the dewatering nip PN to the transfer nip TN, or between the rolls wherein the heaters are arranged, should preferably be at least 1 m to give the endless steel belt 11 time to be heated when passing the heaters and to give the fibrous web time to be heated by the steel belt. In some cases, the distance may have to be larger, up to 7 m. It should be understood that the distances mentioned are applicable to applications using a speed which is in the normal range of speed for a tissue making machine. In the last decade new tissue making machines may operate at a speed of up to about 2000 m/minute. The heaters may thus be producing a surface temperature of about 200-500° C., or a steam heated environment at about 200° C., in order to heat the endless steel belt sufficiently. The heaters $HE_U$ and $HE_L$ may preferably extend some 50-90% of the total distance between the rolls where the heaters are located.

The degree of adhesion of the fibrous web W to the endless steel belt 11 is important. In and immediately after the dewatering nip PN, the adhesion of the fibrous web W to the endless belt 11 is relatively high such that the fibrous web follows the endless steel belt 11 instead of following the water receiving felt 5. After the dewatering nip PN, the adhesion of the fibrous web W to the endless steel belt 11 decreases such that the fibrous web can easily be picked up by the endless textured fabric 12, and preferably as indicated in FIG. 1 using a transfer nip roll 15 (i.e. a suction roll), with a sector in the nip connected to suction/under pressure U.

In many realistic embodiments of the invention, the endless steel belt 11 may run 2-25% faster than the textured fabric 12, which may be compared with some 8%-15% faster than the textured fabric 12 if a PUR coated endless belt is used (assuming all other factors equal), before risks of web breaks becomes dominant. It is highly desirable that the speed difference can be made large, as this improves creping effect at the transfer and hence increased bulk in the produced tissue paper. It has been seen that when the length of the transfer zone is too long, this may cause damage to the web in connection with rush transfer. The higher the speed difference is, the greater the risk that the web be damaged. Since a higher speed difference is desired to obtain higher bulk when producing tissue webs, it is highly desirable that the speed difference can be increased without simultaneously increasing the risk that the web be damaged. The maximum length of the transfer zone should not exceed 40 mm and preferably it should not exceed 30 mm. By using a transfer nip between two rolls 14, 15, it is possible to ensure that the transfer nip can be kept short in the machine direction. Suitably, the length of the transfer nip in the machine direction is 5 mm-30 mm, preferably 15 mm-30 mm. For example, it may be 25 mm. A nip length less than 5 mm is considered impractical. The inventor has found that, when transfer is carried out by means of only a suction shoe as in U.S. Pat. No. 6,287,426 or by means of only suction roll acting on one side of the web, the transfer zone becomes extended and it becomes correspondingly more difficult to achieve reliable web transfer without web damage, especially when the speed difference is larger than 15%. A short transfer zone can be achieved by means of a nip formed between two rolls. Thereby, the transfer can be carried out even reliably and without damage to the web even at speed differences exceeding 15%.

The textured fabric 12 may also risk being damaged in the transfer nip in case its edges should contact the first transfer nip roll 14. This problem is not so serious when there is no speed difference. However, when a speed difference is used in the transfer zone, the problem may become more significant. Damage to the edges of the transfer fabric may also cause damage to the web. To solve or at least reduce this problem, the width (i.e. the extension in the cross machine direction) of the endless steel belt 11 can optionally be made larger than the width of the textured fabric 12. In the same way, the width of the first transfer nip roll 14 suitably exceeds the width of the textured fabric 12 such that it can support the endless steel belt 11 over the entire width of the endless steel belt 11. When the endless steel belt 11 has a greater width than the textured fabric 12, the textured fabric 12 is protected by the endless steel belt 11. Preferably, also the width of the first transfer nip roll 14 exceeds the width of the second transfer nip roll 15 (the suction roll). The width of the endless steel belt 11 may exceed the width of the textured fabric by 10 mm-300 mm.

Preferably, the endless steel belt 11 is impermeable. If it is not entirely impermeable, the permeability to air should preferably not exceed 0.15 m/s measured at a pressure differential of 125 kPa between the two opposite sides of the endless belt 11.

After the transfer nip TN, the web is carried by the textured fabric 12 to a drying cylinder 17. In the embodiment of FIG. 1, the drying cylinder 17 is a Yankee drying cylinder and the web is transferred to the drying cylinder in a second transfer nip formed by a nip roll 20 and the drying cylinder 17. The web W can then be passed on the drying cylinder to a doctor blade 18 that crepes the web W from the drying cylinder 17. The drying cylinder 17 is internally heated by for example steam. The drying cylinder thereby causes water to evaporate from the web W. When the web W has been separated from the surface of the drying cylinder 17, it can be passed to a reel-up wherein a paper roll 24 is formed in a reeling drum 25. The reference numeral 19 refers to a supporting cylinder. Although the drying cylinder 17 must not necessarily be a Yankee cylinder, it is preferred that the drying cylinder is a Yankee cylinder from which the web is creped.

The linear load in the transfer nip is in the range of 0.5 kN/m-15 kN/m. This is a range which may be suitable for a lightly loaded transfer nip in which the nip mainly serves to transfer the web from the steel belt 11 to the textured fabric 12 while being supported by the suction roll 15. The low load contributes to protect the web from damage. However, that a certain load is applied (as opposed to no load at all) is advantageous since it ensures that a certain nip length can be defined such that the transfer zone can be limited. Moreover, a certain linear load improves stability in the nip which protects the web.

The second transfer nip roll 15 may suitably operate with an internal under pressure in the range of 10 kPa-70 kPa. This is a pressure range in which the web is reliably transferred, and which helps the textured fabric 12 to give structure to the web. At the same time, it is not excessively high which could lead to unnecessarily high energy consumption.

In advantageous embodiments of the invention, the transfer nip TN is located at a distance of 1 m-7 m from the dewatering nip PN, preferably at a distance of 2 m-6 m.

Figure 2:
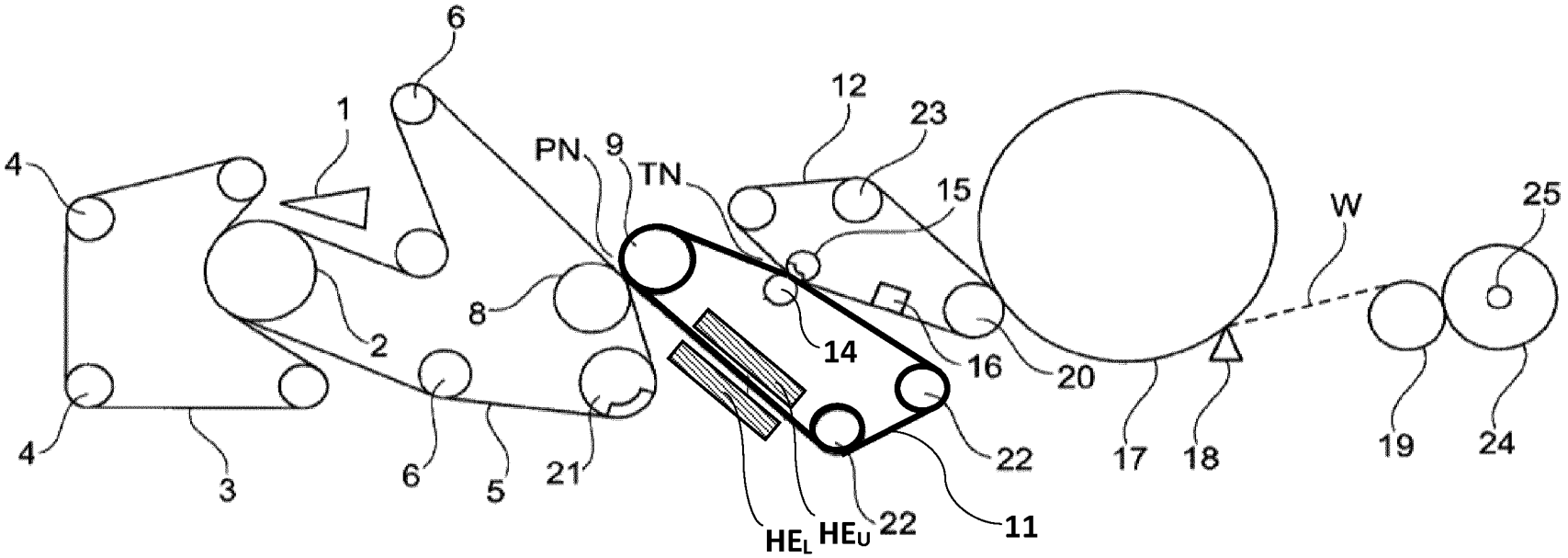
FIG. 2; shows an alternative schematic side view of a second embodiment of the invention with the inventive steel belt running over 4 rolls; in which a Yankee drying cylinder is used for the structured fabric web finally collected on a reeling drum.

The embodiment of FIG. 2 is substantially similar to the embodiment of FIG. 1 except that the endless steel belt 11 is running over 4 rolls (9-14-22-22) instead of only 2 rolls (9-14) as shown in FIG. 1 As shown in FIG. 2 could optionally, a vacuum box 16 be arranged to act on the textured fabric 12 to further mold the fibrous web into the surface of the textured fabric 12 at a point between the transfer nip and the drying cylinder 17. The fibrous web is molded into the surface of the textured fabric by means of the vacuum (under pressure) in the vacuum box. Thereby, the structuring of the web may be improved such that the bulk is further increased. The vacuum box 16 may suitably operate at an under pressure of 20 kPa-70 kPa. This is deemed to be a suitable range for imparting further texture (three-dimensional structure) to the web. For some cases, the upper limit of the under pressure in the vacuum box 16 may be set to 60 KPa.

Figure 3:
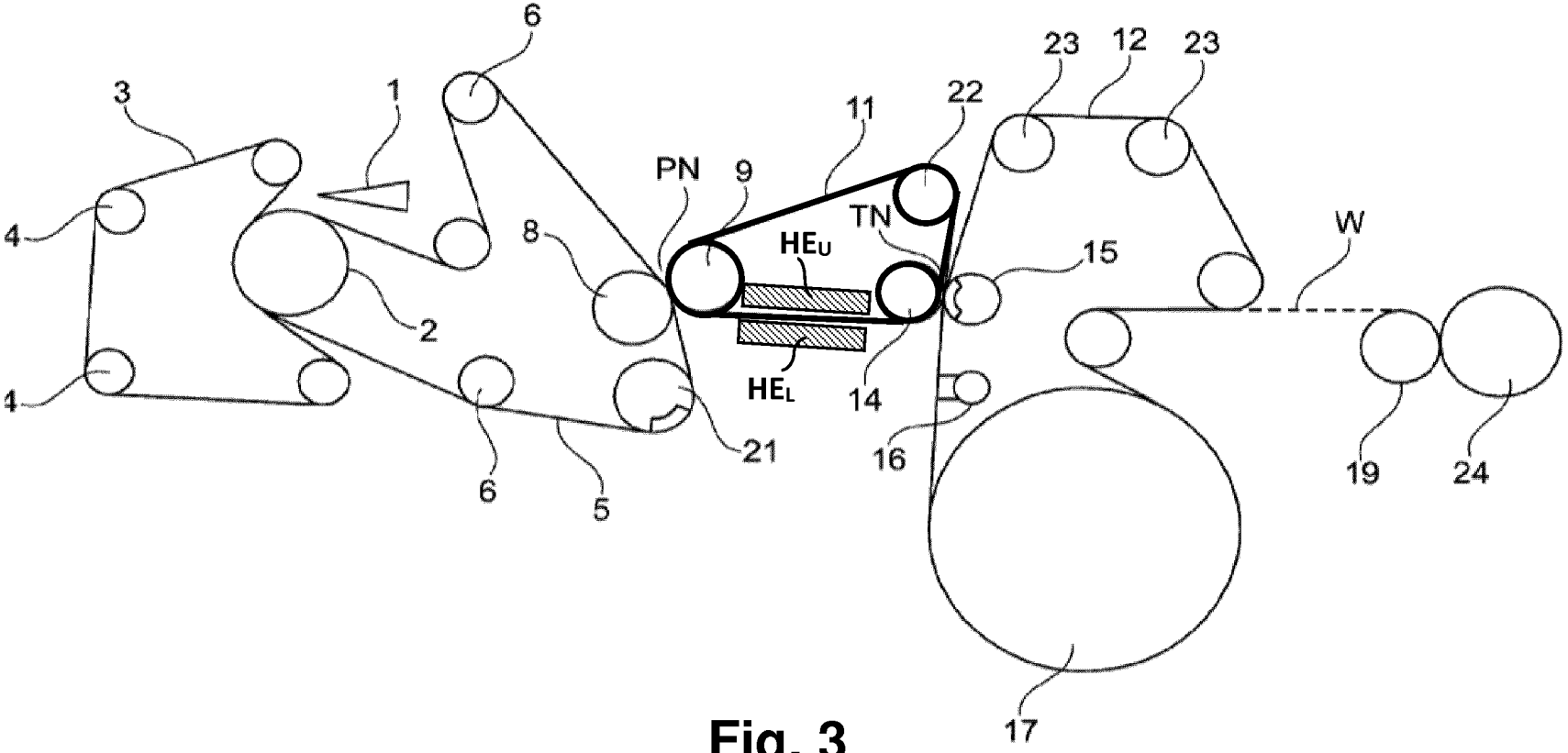
FIG. 3; shows a schematic side view of a third embodiment of the invention with the inventive steel belt running over 3 rolls; in which the drying cylinder is a through air drying cylinder.

With reference to FIG. 3, a third embodiment of the invention is shown. The embodiment of FIG. 3 is substantially similar to the embodiment of FIG. 2 except that the drying cylinder 17 is formed by a through air drying cylinder (TAD cylinder). In this embodiment, the textured fabric 12 is a through air drying fabric (TAD fabric) and hot air is blown from the inner of the cylinder 17 through the textured fabric 12. The textured fabric 12 wraps the fibrous web over a part of the circumference of the drying cylinder 17. The wrap angle may suitably be in the range of 160°-340°.

Figure 4:
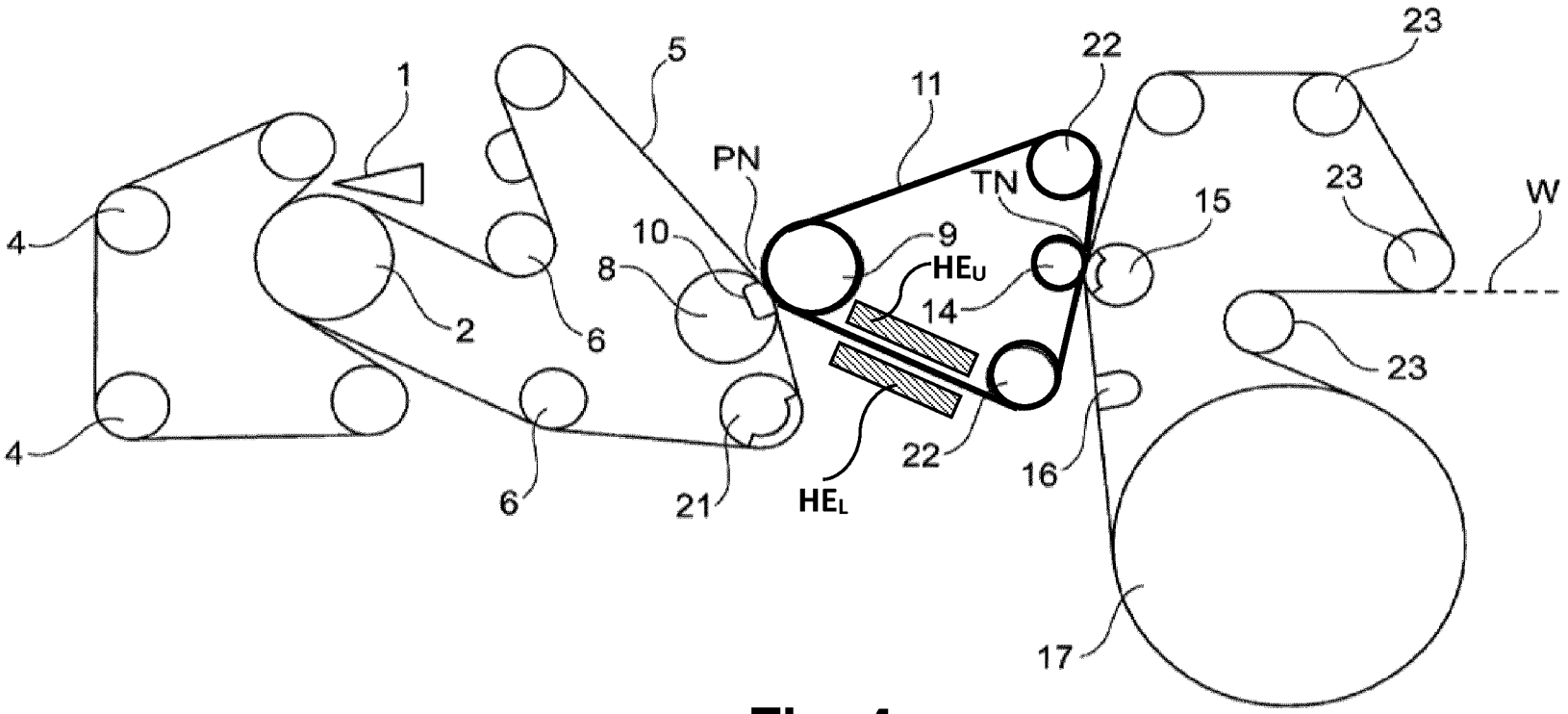
FIG. 4; shows a schematic side view of a fourth embodiment of the invention which is similar to FIG. 3 except for the inventive steel belt running over 4 rolls.

The embodiment of FIG. 4 is substantially similar to the embodiment of FIG. 3 but the first press unit 8 is here formed by an extended nip roll that may have an internal shoe which is looped by a flexible belt. In all embodiments of the present invention, an extended nip roll having an internal shoe looped by a flexible belt could be used. Such extended nip rolls (sometimes also referred to as shoe press rolls) are disclosed in the prior art, see for example U.S. Pat. Nos. 5,662,777, 6,083,352, U.S. Pat. No. 7,527,708 or EP 2085513. These documents disclose examples of extended nip rolls (shoe rolls) that could be used as extended nip rolls in the present invention. In the embodiment of FIG. 4, it is the first press unit 8 that is an extended nip roll but it should be understood that it could instead be the second press unit 9 that is an extended nip roll. In the same way, an extended nip roll could be used in the embodiment of FIG. 2 or FIG. 3. If one press unit 8, 9 is an extended nip roll, the other press unit 8, 9 could optionally be a deflection controlled roll (a deflection compensated roll) which is has a shell that is internally supported by shoes or by one or several hydraulic chambers.

Figure 5:
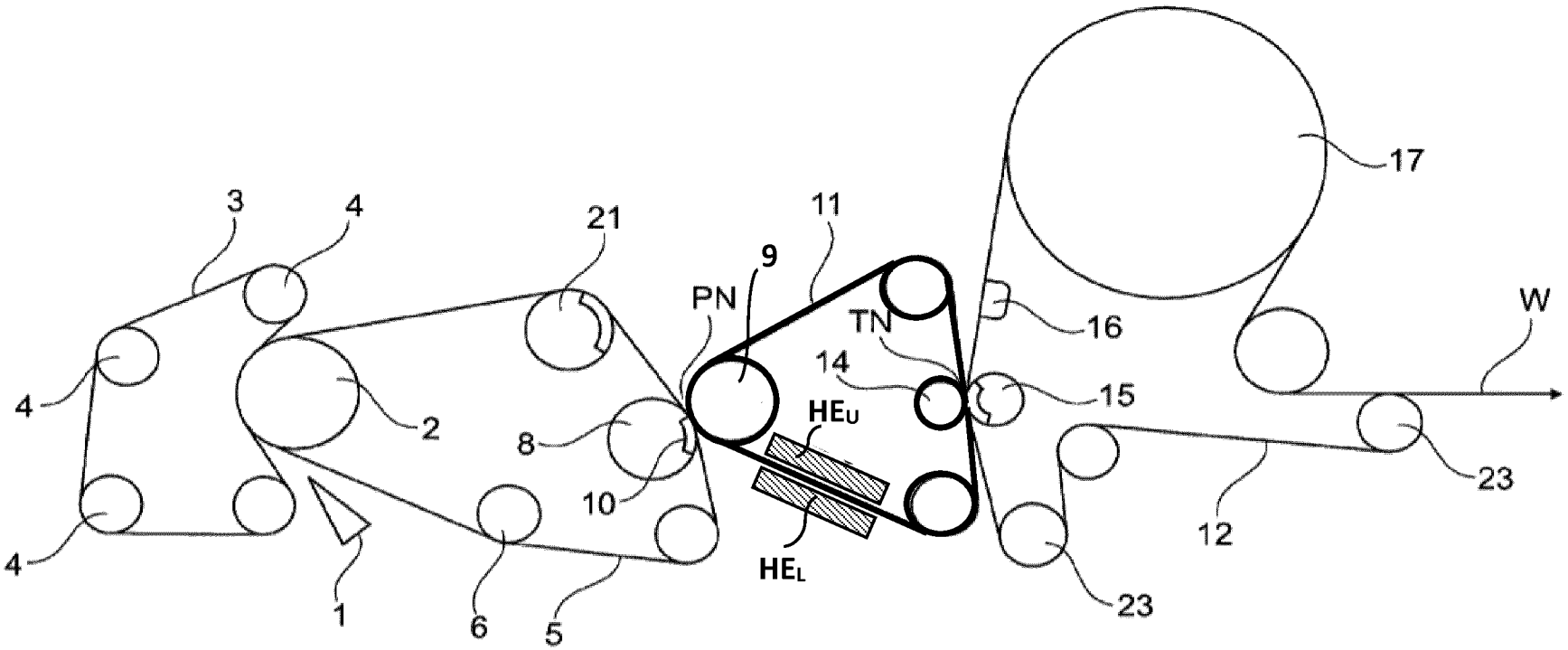
FIG. 5; is a schematic representation of a fifth embodiment of the invention which is similar to FIG. 4 but with the head box feeding the pulp suspension onto the felt from below; and finally

The embodiment of FIG. 5 is substantially similar to the embodiment of FIG. 4 but here the forming section has been designed differently and the drying cylinder 17 (which is also here a through air drying cylinder) is placed in a high position (as opposed to the lower position in FIG. 3).

Figure 6:
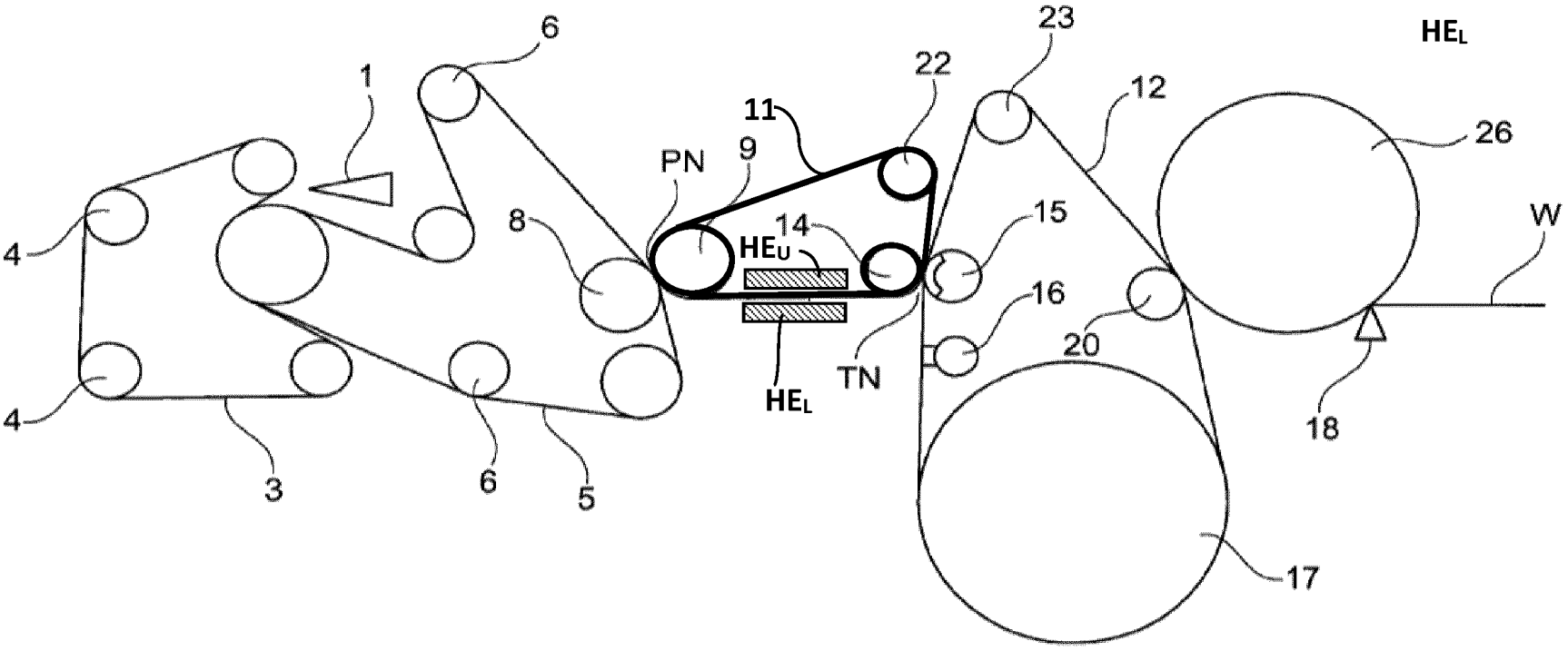
FIG. 6 is a schematic representation of yet another embodiment in which the drying of the web takes place in a final sequence of a first through air drying cylinder followed by a Yankee.

In the embodiment of FIG. 6, the layout is similar to that of FIG. 5 but in this is embodiment, the drying cylinder 17 which is a through aft drying cylinder is followed by a second drying cylinder 26 which is a Yankee drying cylinder. A nip roll 20 within the loop of the textured fabric 12 forms a nip with the second drying cylinder 26. In this nip, the web W is transferred to the Yankee drying cylinder from which it is creped by a doctor blade 18.

In many embodiments, the dewatering nip is a nip using an extended nip roll. In such embodiments, the linear load in the dewatering nip may be in the range of 200 kN/m-1000 kN/m, preferably 300 kN/m-800 kN/m. However, peak pressure in the dewatering nip is more important than linear load. The peak pressure is the highest pressure in the nip (the actual pressure typically varies in the machine direction). Suitably, the peak pressure may be in the range of 2 MPa-8 MPa. Preferably, the peak pressure should be in the range of 4 MPa-7 MPa. Generally, a higher linear load can be used when an extended nip roll is used such that the dewatering nip is an extended nip (such as a nip formed between a shoe press roll and a cylindrical counter roll). This is because an extended nip roll makes it possible to distribute the linear load over a larger nip area such that the peak pressure becomes lower than in a nip between two conventional rolls. At a given nip length, the average pressure is determined by the linear load. Peak pressure is determined not just by the linear load and nip area but also by the geometry of the nip which can determine pressure distribution. The linear load, and thereby the pressure in the nip, should be high enough to press out as much water as possible since a high dry solids content before the drying cylinder reduces the energy consumption for the drying cylinder (less water must be evaporated). However, a high linear load with a correspondingly high peak pressure may reduce the bulk of the fibrous web; the caliper (thickness) of the web is reduced which is undesirable. Tissue paper should preferably have a high bulk, i.e. a high caliper also when the basis weight is low. In many realistic embodiments, the linear load in the dewatering nip may be in the range of 350 kN/m-700 kN/m when one of the press units 8, 9 is an extended nip roll (depending on nip length). For example, the linear load could be in the range of 400 kN/m-600 kN/m. The peak pressure should not exceed 8 MPa since a higher peak pressure is likely to cause significant reduction of bulk. If the dewatering nip is a roll nip which does not include an extended nip roll, the nip length will be shorter which may make it necessary to use a smaller linear load. In many cases, it may be suitable to limit the peak pressure to 7 MPa. At the same time, if the linear load and the pressure is too low, dewatering will not be so effective. Therefore, the pressure should be allowed to rise such that peak pressure reaches at least 2 MPa and preferably to 4 MPa.

In all embodiments, the dewatering nip may be an extended nip or a short roll nip.

The use of a short transfer nip which is 5 mm-40 mm reduces the risk that the web is damaged during transfer to the textured fabric. By using a steel belt that is wider than the textured fabric, the textured fabric and especially the edges thereof is also protected in the transfer nip and the risk of damage to the textured fabric is reduced. Thereby, also the risk of damage to the web in the transfer nip is reduced since a damaged textured fabric could cause damage to the web, especially during transfer of the web.

In those embodiments where the textured fabric is a through air drying fabric (a TAD fabric), this fabric may be, for example, such a fabric as is sold by Albany International under the name Prolux 003 or under the name ProLux 005.

The invention is primarily intended for such tissue paper grades that have a basis weight in the range of 10 $g/m^2$–30 $g/m^2$ but in some cases, it can be used also for papers with even lower weight, e.g. down to 7 $g/m^2$. Normally, it would be used for papers with a basis weight in the range of 14 $g/m^2$–28 $g/m^2$. The indicated ranges for basis weight refer to the weight of the ready-dried web, i.e. the basis weight of the paper that is rolled to a paper roll on a reeling drum.

The endless steel belt 11 that is used should have smooth surface, but the surface may have micro-scale depressions or dimples.

A belt which is a suitable choice for the endless steel belt 11 is sold by Contibelt under the name CB 630 SGM, a cold rolled stainless steel with martensitic structure. This steel quality has good spring properties, high ductility and high strength as well as very good weldability. By precipitation hardening, different levels of tensile strength can be obtained, according to the customers' individual requirements. The surface is mill finish according to 2B of ASTM with a selected cold rolled temper finish. The surface is smooth and clear as well as metallically clean. Alternative qualities may be obtained from Sandvik in form of the 1650; and 1500SAF Qualities.

Embodiments are conceivable in which the fibrous web is formed between two forming wires and subsequently conveyed from one of the forming wires to the felt that passes through the dewatering nip. However, it is preferable that the felt that passes through the dewatering nip is also one of the fabrics used in the forming section. Such a design makes the layout of the machine shorter and simpler. Less space will be required for the machine.

The invention can be used for tissue applications where the speed difference in rush transfer (the speed difference in the transfer nip TN) is larger than 15% and preferably larger than 17% which is almost double the speed difference obtainable when using PUR coated transfer belt according to U.S. Pat. No. 8,871,060. This improvement may be used in several approaches. In an existing tissue machine could the speed of the forming section be increased by some 17% while the speed of the transfer belt 11 is kept at original speed, thus increasing the crep rate at transfer to the textured fabric and by that increasing the bulk of the final tissue web. Alternatively, the production capacity could be increased by 17% in the entire tissue machine (maintaining same bulk), or any tradeoff between these extremes.

By using a transfer nip with a nip length which does not exceed 40 mm for transferring the fibrous web to the textured fabric 12, it is possible to achieve web transfer at higher speed differences than 17%. However, the invention can also be applied to such cases where the speed difference is lower than 17% in order to reduce the risk that the web be damaged in the transfer nip TN. There are cases where the invention may be useful even when the speed difference is only 2%.

The invention claimed is:

1. A method of producing a structured fibrous web of paper suitable for tissue products, the method comprising the steps of:

forming a fibrous web and conveying the formed fibrous web on a water receiving felt to a dewatering nip formed by a first press unit and a second press unit and where an endless steel belt is passed through the nip together with the fibrous web and the water receiving felt, the endless steel belt having at least a steel surface which contacts the fibrous web in the dewatering nip;

after the dewatering nip, conveying the fibrous web by the endless steel belt to an endless textured fabric which is permeable to air and to which the web is transferred from the endless belt, the textured fabric running at a lower speed than the endless steel belt and a speed difference in the range 2-25% (RT %), causing a wet creping effect increasing the bulk of the fibrous web;

and after the transfer to the textured fabric, conveying the fibrous web by the textured fabric to a drying cylinder, wherein:

the endless steel belt is heated by heating medium in a position at least partly before the fibrous web is applied onto the endless steel belt; and the web is transferred from the endless steel belt to the textured fabric in a transfer nip, the transfer nip being formed between a first transfer nip roll that lies within the loop of the endless steel belt and a second transfer nip roll which is a suction roll located within the loop of the textured fabric, the transfer nip having a length in the machine direction which is in the range of 5 mm-40 mm.

2. The method according to claim 1, wherein the endless steel belt has a speed that is 15% higher than the speed of the textured fabric.

3. The method according to claim 2, wherein the endless steel belt is heated on both sides of the belt.

4. The method according to claim 3, wherein the endless steel belt is heated in a heating zone extending at least 50-70% of a distance ranging from 1 to 7 meters.

5. The method according to claim 4, wherein the endless steel belt runs in a loop over at least two rolls that deflects the endless steel belt over at least 90 degrees of the circumference of the rolls and that the rolls may have a function as a guide roll, a press roll or a transfer nip roll and the total length of the endless steel belt exceeding the total circumference of the rolls by a factor above 2.

6. A machine for producing a structured fibrous web of paper suitable for tissue products, the machine comprising:

a forming section that includes a first (3) and a second (5) forming fabric;

a dewatering nip (PN) defined by a first (8) and a second (9) press unit, through which dewatering nip a water receiving felt (5) is arranged to carry a fibrous web (W) formed in the forming section;

an endless steel belt (11) arranged to run in a loop over at least two rolls (9,14) through the dewatering nip and arranged to pick up the paper web and having at least one steel surface facing the paper web that passes through the dewatering nip;

at least one heater ($HE_L$ $HE_U$) arranged close to the endless steel belt and heating the steel belt in a position at least partly before the fibrous web is applied onto the endless steel belt;

a textured fabric (12) arranged to pick up the paper web from the endless steel belt (11) at a point downstream of the dewatering nip; and a drying cylinder (17) to which the textured fabric is arranged to carry the paper web; and a transfer nip (TN) in which the paper web is transferred from the endless steel belt to the textured fabric, the transfer nip being formed between and by a first transfer nip roll (14) located within the loop of the endless steel belt and a second transfer nip roll (15) which is a suction roll that is located within the loop of the textured fabric, the textured fabric (12) driven by rolls (15,20) in the loop of the textured fabric loop at a lower speed than the endless steel belt (11) driven by rolls (9,14) in the loop of the endless steel belt (11) at a speed difference in the range 2-25%; the transfer nip having a nip length in the machine direction that is in the range of 5 mm-40 mm.

7. The machine according to claim 6, wherein the heater is a heating box ($HE_U$ or $HE_L$) arranged immediately close to a surface of the endless steel belt and heated by steam.

8. The machine according to claim 7, wherein the endless steel belt is heated on both sides of the endless steel belt by an upper heater ($HE_U$) and a lower heater ($HE_L$).

9. The machine according to claim 7, wherein the endless steel belt is heated in a heating zone with heaters extending at least 50-70% of a distance ranging from 1 to 7 meters between two rolls supporting the loop of the endless steel belt.

10. The machine according to claim 6, wherein the endless steel belt is heated by at least one steam heated roll supporting the loop of the endless steel belt.

11. The machine according to claim 6, wherein the endless steel belt (11) runs in a loop over at least two rolls (9,14) that deflects the endless steel belt over at least 90 degrees of the circumference of the rolls and that the rolls may have a function as a guide roll, a press roll or a transfer nip roll and the total length of the endless steel belt exceeding the total circumference of the rolls by a factor above 2.

12. The machine according to claim 11, wherein the drying cylinder is a Yankee drying cylinder to which the paper web is transferred from the textured fabric in a second transfer nip formed between a nip roll and the Yankee cylinder; and in which a doctor blade is arranged to act on the Yankee cylinder.

13. The machine according to claim 11, wherein the drying cylinder is a through air drying cylinder which is wrapped by the textured fabric over a part of its circumference.

14. The machine according to claim 11, wherein the subsequent drying of the fibrous web after transfer from the textured web takes place on a sequence with at least one through air drying cylinder and a final Yankee cylinder.

* * * * *